US006234594B1

(12) United States Patent
Di-Rosa

(10) Patent No.: US 6,234,594 B1
(45) Date of Patent: May 22, 2001

(54) HOUSING FOR FREEZER CABINETS, AND HOUSING SYSTEM

(75) Inventor: Vincenza Di-Rosa, Rome (IT)

(73) Assignee: Unilever Patent Holdings BV, Vlaardingen (NL)

( * ) Notice: Subject to any disclaimer, the term of this patent is extended or adjusted under 35 U.S.C. 154(b) by 0 days.

(21) Appl. No.: 09/367,707

(22) PCT Filed: Feb. 11, 1998

(86) PCT No.: PCT/EP98/00769

§ 371 Date: Nov. 10, 1999

§ 102(e) Date: Nov. 10, 1999

(87) PCT Pub. No.: WO98/37370

PCT Pub. Date: Aug. 27, 1998

(30) Foreign Application Priority Data

| | | |
|---|---|---|
| Feb. 20, 1997 | (DE) | 297 03 042 U |
| Jun. 3, 1997 | (DE) | 297 09 654 U |
| Jul. 1, 1997 | (DE) | 297 11 483 U |

(51) Int. Cl.[7] ..... A47G 29/00

(52) U.S. Cl. ..... 312/265.6; 312/265.5; 312/116

(58) Field of Search ..... 312/253.1, 265.1, 312/265.2, 265.3, 265.4, 265.5, 265.6, 114, 116, 401, 402

(56) References Cited

U.S. PATENT DOCUMENTS

| | | | | |
|---|---|---|---|---|
| 777,895 | * | 12/1904 | Geraci | 312/116 X |
| 1,387,486 | * | 8/1921 | Gray | 312/116 |
| 1,896,693 | * | 2/1933 | Battista | 312/116 X |
| 2,598,957 | * | 6/1952 | Wolfe | 312/265.5 X |
| 2,741,101 | * | 4/1956 | Trulaske | 312/116 X |
| 3,729,243 | | 4/1973 | Musgrave et al. . | |
| 4,320,933 | * | 3/1982 | Felix et al. | 312/265.6 X |
| 4,449,761 | * | 5/1984 | Davis et al. | 312/116 X |
| 5,567,026 | * | 10/1996 | Lacewell | 312/116 X |
| 5,671,991 | * | 9/1997 | Grant | 312/401 X |
| 5,752,624 | * | 5/1998 | Vinson et al. | 312/265.6 X |
| 6,012,790 | * | 1/2000 | Thomas et al. | 312/265.5 X |

FOREIGN PATENT DOCUMENTS

| | | | | |
|---|---|---|---|---|
| 3513202 | * | 10/1986 | (DE) | 312/116 |
| 297 16 713 U | | 11/1997 | (DE) . | |
| 2 149 488 | | 6/1985 | (GB) . | |
| 94 07097 | | 3/1994 | (WO) . | |

* cited by examiner

*Primary Examiner*—Peter M. Cuomo
*Assistant Examiner*—Hanh V. Tran
(74) *Attorney, Agent, or Firm*—Pillsbury Winthrop LLP

(57) ABSTRACT

A housing for a freezer installation for storing frozen foodstuffs comprises a rectangular base unit, a rectangular top frame of plastic which encloses an access opening and bears a movable cover arrangement which closes or releases the access opening of the top frame, two mutually opposite side-part members of essentially the same outline, each having an opening and side panels of metal, arranged on one side of the housing with their surfaces visible through the openings in the side-part members. The housing also includes a rear-wall panel of metal, and a front-wall panel of metal. A modular housing system for housings of different volumes is provided.

20 Claims, 8 Drawing Sheets

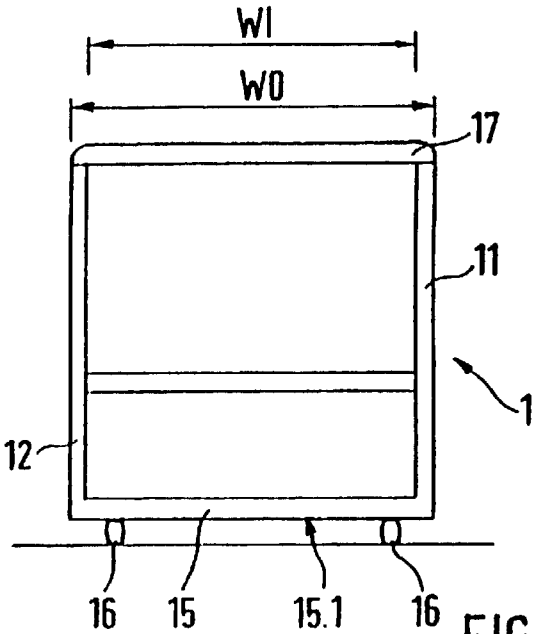
FIG.2
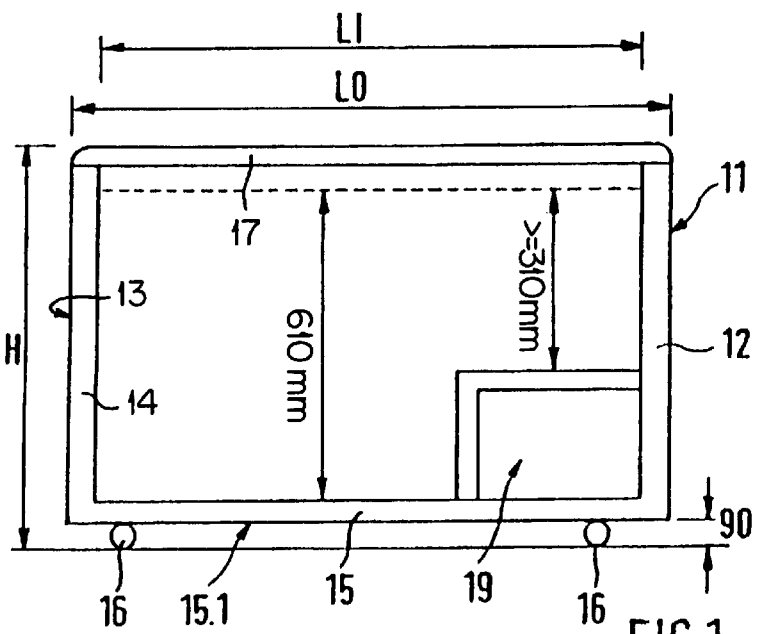
FIG.1
| VOLUMEN | " LO" | "LI" | "H" | "WO" | "WI" |
|---|---|---|---|---|---|
| 1 | 680 | 530 | 900 | 650 | 500 |
| 2 | 1050 | 900 | 900 | 650 | 500 |
| 3 | 1250 | 1100 | 900 | 650 | 500 |
| 4 | 1500 | 1350 | 900 | 650 | 500 |
FIG.3

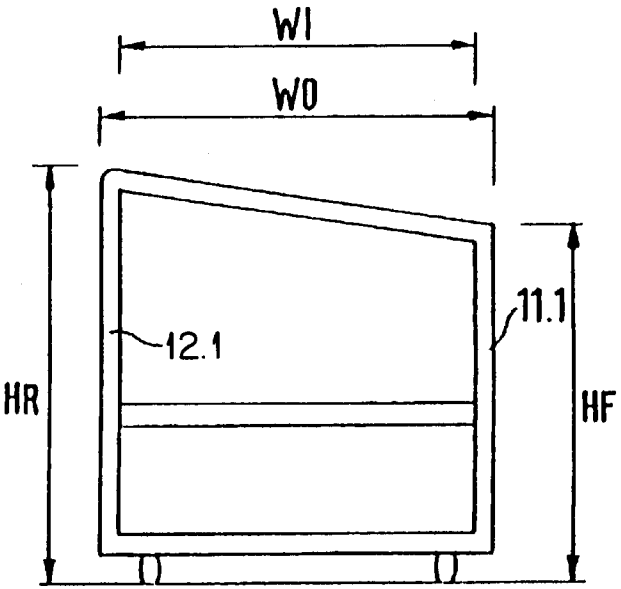
FIG.6
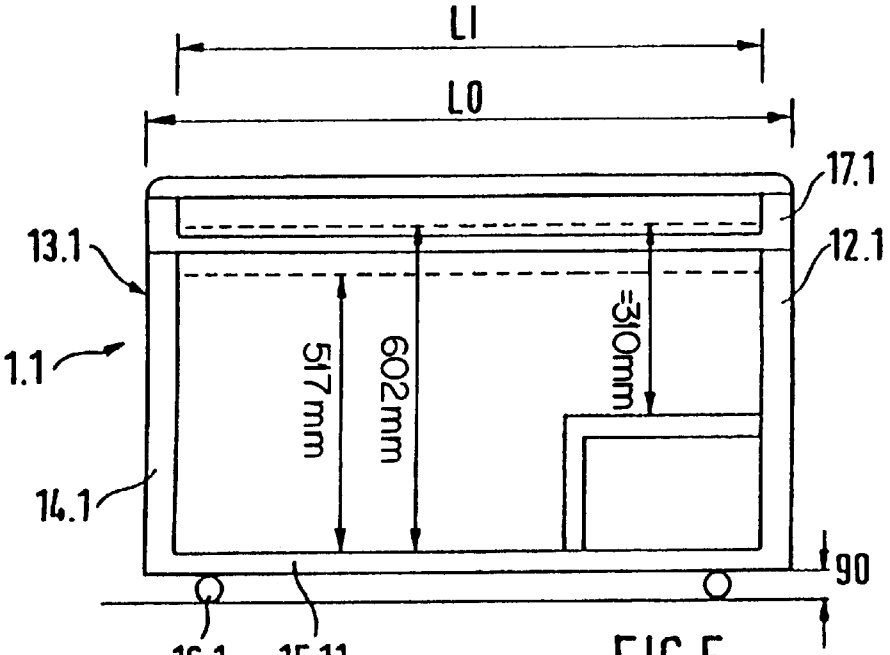
FIG.5
| VOLUMEN | "LO" | "LI" | "HF/HR" | "WO" | "WI" |
|---|---|---|---|---|---|
| 1 | 680 | 530 | 760/900 | 650 | 500 |
| 2 | 1050 | 900 | 760/900 | 650 | 500 |
| 3 | 1250 | 1100 | 760/900 | 650 | 500 |
| 4 | 1500 | 1350 | 760/900 | 650 | 500 |
FIG.7

HOUSING FOR FREEZER CABINETS, AND HOUSING SYSTEM

The present invention relates to a housing for a freezer cabinet, which is used, for example, for storing ice-cream or other frozen foodstuffs, e.g. in restaurants, kiosks or other sales locations, and to an associated housing system.

In the case of freezer cabinets, the trend is moving towards units of lower and lower weight, which facilitates handling of the freezer cabinet when it has to be transported or moved on site. Freezer cabinets and similar freezer installations which consist essentially of plastic parts, in which both inner load-bearing parts and outer parts, e.g. visible frame parts and side panelling, are produced from plastics, have therefore been developed. In addition to the lower weight, these plastic freezer cabinets also have greater elasticity than metallic freezer cabinets, as a result of which damage to the plastic freezer cabinet due to, for example, impact loading can be prevented in many cases. However, it has been shown that, in many cases, these plastic freezer cabinets have relatively poor efficiency and irregular heat distribution in the interior of the freezer cabinet.

In DE 297 16 713 which was published after the priority date of the present invention, a freezer cabinet is disclosed the peripheral wall of which is formed as a hollow cylinder with a circular basis.

In U.S. Pat. No. 3,729,243 a merchandising cabinet, particularly a cabinet for storing and displaying containers of ice-cream, is disclosed which has a transparent window means and a curved transparent lid closing the upper front and top of the cabinet. This document is especially concerned with the construction and design of the transparent lid permitting both the customer and the server to view the merchandise in the cabinet with the lid open or closed.

It is the object of the present invention to specify a housing or a housing system for a freezer cabinet which is flexible and comfortable in use and easy to assemble.

Accordingly, the inventive housing for a freezer installation, in particular a freezer cabinet, for storing frozen foodstuffs comprises a base unit of rectangular outline, a top frame which consists of plastic, is rectangular, runs all the way round, is located opposite the base unit, encloses an access opening and bears a movable cover arrangement which closes or releases the access opening of the top frame, two mutually opposite side-part arrangements which are provided laterally on the housing, of essentially the same outline, extend from the base unit to the top frame of the housing and each have an opening or a cutout, metallic side panels, of which each is arranged on one side of the housing and of which surfaces are visible through the openings in the side-part arrangements, a rear-wall panel which is situated on a rear side of the housing, consists of metal and extends between the side-part arrangements and from the top frame to the base unit, and a front-wall panel which is situated on a front side of the housing, consists of metal, is located opposite the rear-wall panel and extends between the side-part arrangements and from the top frame to the base unit, it being the case that the side-part arrangements, the base unit, the top frame with cover arrangement, the front-wall panel and the rear-wall panel bound a housing volume.

Using a plastic frame and plastic top frame provides the inventive housing for a freezer cabinet with favourable properties as regards resistance to impact loading and damage to the known plastic freezer cabinets with relatively low weight. Furthermore, in comparison with the known plastic freezer cabinets, the housing according to the invention has better efficiency or better heat balance, which is attributed to the relatively large-surface-area, metallic sides or panelling, e.g. the side panels and/or the rear-wall panel and/or the front-wall panel, which contribute, for example, to more favourable interior heat transmission and/or distribution in the freezer cabinet.

The modular housing system according to the invention has housings which each comprise the following components: a base unit of rectangular outline, a top frame which consists of plastic, is rectangular, runs all the way round, is located opposite the base unit, encloses an access opening and bears a movable cover arrangement which closes or releases the access opening of the top frame, two mutually opposite side-part arrangements which are provided laterally on the housing and extend from the base unit to the top frame of the housing, a rear-wall panel which is situated on a rear side of the housing, consists of metal and extends between the side-part arrangements and from the top frame to the base unit, and a metallic front-wall panel which is situated on a front side of the housing, is located opposite the rear-wall panel and extends between the side-part arrangements and from the top frame to the base unit, it being the case that the side-part arrangements, the base unit, the top frame with cover arrangement, the front-wall panel and the rear-wall panel bound a housing volume. In this case, the side-part arrangements are of the same shape and the same dimensions for all volumes of the housings at least of one housing type.

Since the side-part arrangements and, for example, also the side panels are modular and standardized components which are of at least the same shape and dimensions, for all volumes, at least for the housings of one housing type or volume type, all that is then necessary is for the other components, e.g. the front-wall panel, the cover arrangement, the rear-wall panel, the top frame and the base unit, etc., of the modular housing system according to the invention to be adapted to the respective volume of the housing in terms of their length dimensions, in order to assemble housings with different volumes. As a result, the housings can be adapted to the respective specifications, such as volume size, illustrations, etc., without high outlay.

Advantageous configurations, advantages and possible applications of the present invention can be gathered from the following description of embodiments of the present invention in conjunction with the attached drawings, in which:

FIG. 1 shows a front view of the framework of a first embodiment of the present invention, for a first housing type;

FIG. 2 shows a side view of the framework of FIG. 1;

FIG. 3 shows a self-explanatory table of dimensions for the embodiment of FIGS. 1 and 2 in relation to various volumes;

FIG. 5 shows a front view of the framework of a second embodiment of the present invention, for a second housing type;

FIG. 6 shows a side view of the framework of FIG. 5;

FIG. 7 shows a self-explanatory table of dimensions for the second embodiment, shown in FIGS. 5 and 6, in relation to various volumes;

Figure 4:
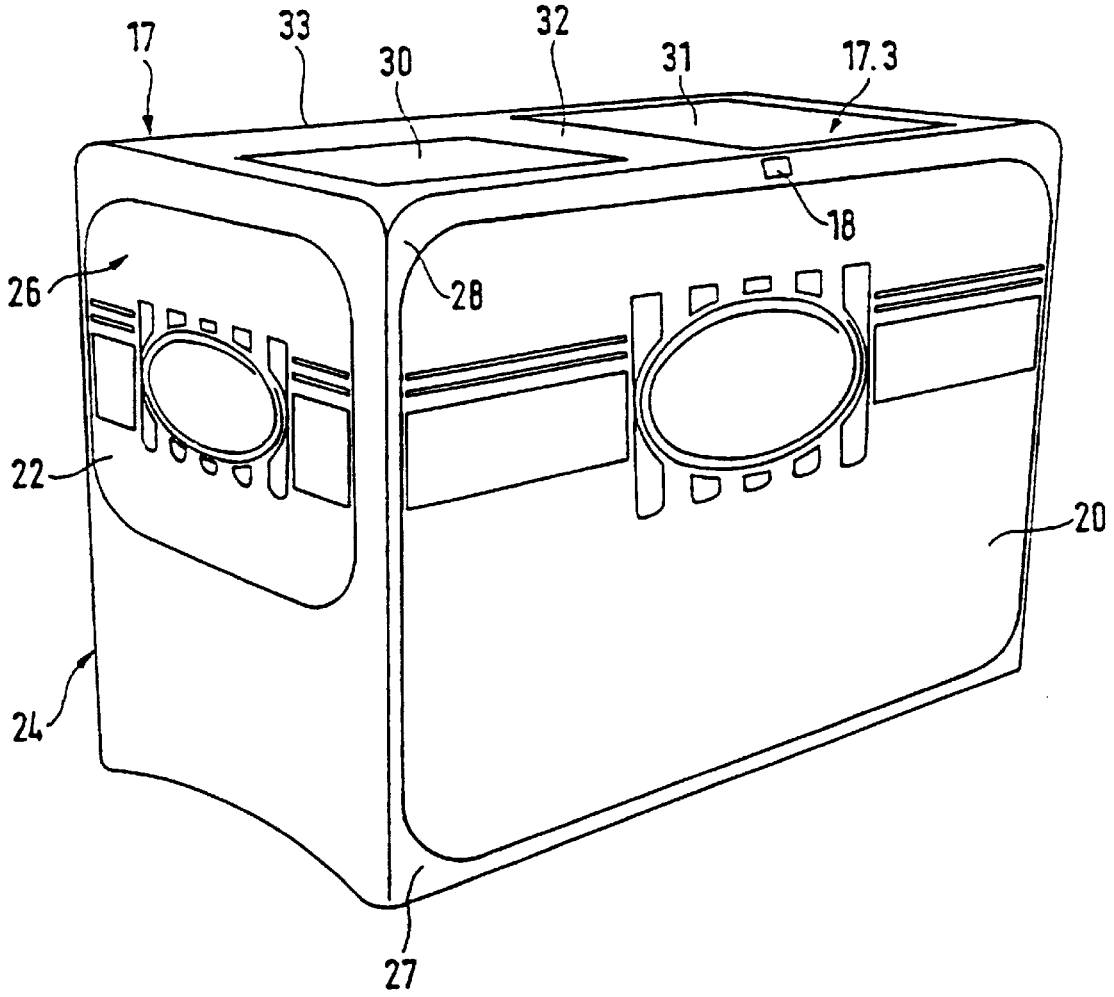
FIG. 4 shows a ready-assembled housing of the present invention with the framework of FIGS. 1 and 2.

FIGS. 1 and 2 show a framework 1 for a housing according to a first embodiment of the present invention. The framework 1 shown may consist, for example, of plastic and comprises four vertical members 11, 12, 13 and 14 which are arranged on the side edges of an imaginary cuboid, are of the same length, are located perpendicularly with respect to a base unit 15 of the framework 1 and are fastened on the base unit 15, e.g. by screwed connection. The base unit 15 may consist of metal, e.g. aluminium, or of plastic and may comprise, for example, a continuous, single-piece and rectangular base panel or a single-piece base frame of rectangular outline and a base panel arranged on the base frame. Alternatively to this, it is also possible for the base frame to be made up of appropriate longitudinal and transverse members, as individual elements which are fastened to one another, and to consist of plastic.

Fastened on an underside 15.1 of the base unit 15 of the framework 1 are four rollers 16, which provide the framework 1, and thus the housing or the freezer cabinet as a whole, with the necessary mobility. The rollers 16 are fastened on the base unit 15 such that, when the housing is in the ready-installed state, they can no longer be seen, or are concealed, when the viewer is in a standing position. They are thus set back to a sufficient extent from the rectangular outline of the base unit 15.

Opposite the base unit 15, the vertical members 11, 12, 13 and 14 are fastened at the ends on a top frame 17 which runs all the way round and has essentially a rectangular outer boundary and likewise a rectangular inner boundary. The top frame 17 may be designed from plastic as a single-piece frame or may be made up of individual longitudinal and transverse members and webs and have an attachable casing. The rectangular top frame 17 is rounded in the corner regions. The longitudinal and transverse edges of the top frame 17 which are oriented upwards away from the housing are also rounded. The display of a digital thermometer 18 (see FIG. 4) for indicating the temperature inside the freezer cabinet is fitted on the top frame 17.

Inside, the top frame 17 is provided with two guides 17.4 one above the other (see FIG. 9), which may be designed, for example, as sunken grooves. The guides 17.4 guide covers 30 and 31 which are inserted into them and may be displaced in order to render the interior of the housing or of the freezer cabinet accessible, via an access opening 17.3 of the top frame 17, for the purpose of removing or storing the frozen items, or in order to close the same. The covers 30 and 31 of the cover arrangement 33, without a dirt trap, may comprise rectangular, transparent glass panels or plastic panels of the same size or may consist of an opaque or non-transparent material. The otherwise exposed edge of the top cover 31 is enclosed by an insulation web 32, which moves along with the cover 31 and is positioned on the cover 30 located therebeneath. The plastic insulation web 32 also seals the slit between the two covers 30 and 31 in the closed state of the freezer cabinet.

Partitioned off in the interior of the framework 1 is a compartment or chamber 19 which serves for accommodating the conventional freezing equipment and units (not shown). The conventional interior fittings of the housing are not shown.

As FIG. 4 shows, the housing according to the invention also comprises a relatively large-surface-area front-wall panel 20 which is arranged on the front side of the housing and may comprise, for example, a sheet-steel panel or sheet-metal panel, e.g. an aluminium panel. The front-wall panel 20 may be provided with a company logo or with an illustration of the types of ice-cream available or a similar illustration. The front-wall panel 20 may be fastened, or screwed, for example on retaining means designed for this purpose (not shown), e.g. snap-in devices, on the vertical members 11 and 13 and/or on the top frame 17 and the base unit 15, it being possible for the front-wall panel 20 to be fastened, preferably in the region of its corners, on the retaining means or fastening surfaces arranged correspondingly on the framework 1. The front-wall panel 20 occupies essentially the entire front side of the housing.

Opposite the front-wall panel 20, there is arranged on the rear side of the housing, that is to say in the region between the vertical members 12 and 14 (not shown), a rear-wall panel 21 (see FIG. 11), which may be of identical design to the front-wall panel 20, but is not usually provided with illustrations since it is mostly arranged against the wall of a room when the freezer cabinet has been set up at its location of use. In the same way as the front-wall panel 20, the rear-wall panel 21 may be fastened on corresponding retaining means or fastening surfaces on the framework 1.

Arranged laterally on the housing, that is to say between the vertical members 11 and 12 and also between the vertical members 13 and 14, is in each case one side panel 22, 23. The side panels 22 and 23 are of identical dimensions, but only occupy the top section on the sides of the housing. They are produced from metal, e.g. sheet steel, aluminium, etc., and are fastened, e.g. by screwed connection or in the same way as the front-wall panel 20, on correspondingly designed retaining means or fastening surfaces provided on the vertical members 11, 12 and 13, 14 and/or on the top frame 17. The outsides of the side panels 22 and 23 may be provided with the abovementioned illustrations.

Figure 10:
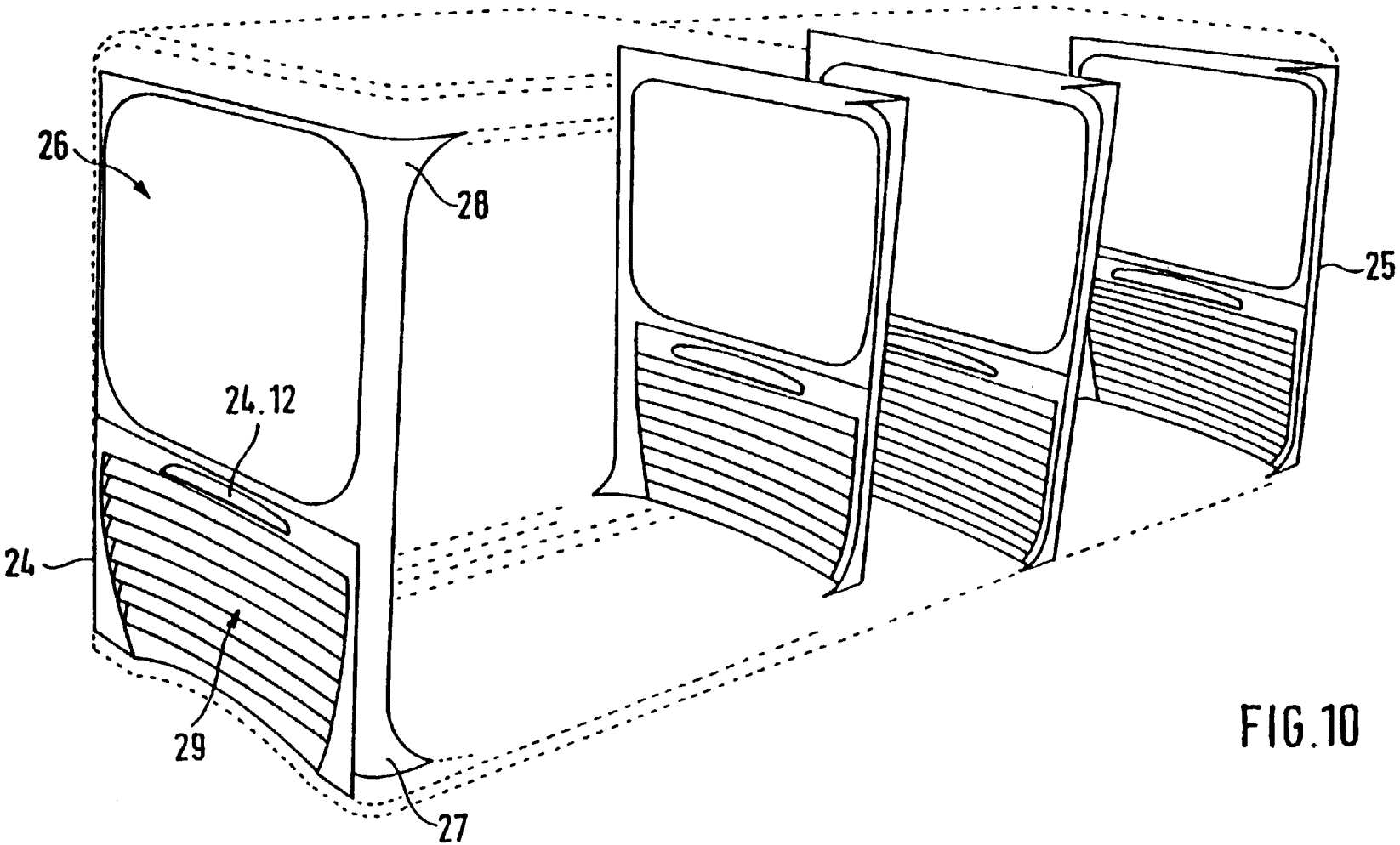
FIG. 10 shows a schematic illustration of the side-part arrangements together for the purpose of illustrating the mutual positioning of the sidepart arrangements in the case of the first embodiment, shown in FIGS. 1 and 2.

Fitted laterally on the housing are side-part arrangements which preferably consist of plastic, are designed as side parts 24 and 25 of the same shape and dimensions (see also FIG. 10) and are each essentially in one piece. Each of these side parts 24 and 25 is of essentially rectangular outline, as can be seen clearly from FIG. 10. In the top region, the side part 24 has an opening 26, which exposes, and renders visible, the side panel 22. However, in particular in the corner region, the outline of the opening 26 is smaller than the outline of the side panel 22, in order that slits between the framework 1 and the side panel 22 which are unavoidable, for example for tolerance reasons, can be reliably covered when the side part 24 is fastened on the framework 1. The side part 24 (and also the side part 25) extends from the side region of the housing, by way of corner pieces 27, 28, to the front side of the housing, and thus also covers, in particular, the adjoining corner regions of the front-wall panel 20 when the side part 24 is attached to the framework 1. The vertical edges of the side parts 24 and 25 are rounded and constitute the visible vertical edges of the housing. Towards the base unit 15, the side part 24 (and also the side part 25) has a plurality of mutually parallel ventilation slits 29, which serve for discharging the waste heat produced during cooling. The ventilation slits 29 may also be formed in a cover which can be inserted into the side part 24 or may be articulated thereon, for example with swing action. A handle 24.12 is formed on each of the side parts 24 and 25. For the purpose of fastening the side parts 24 and 25 on the framework 1, use may be made, for example, of a latching and self-retaining spring/counterspring system (not shown). In this fastening system, a spring or catch snaps into an elastic counterspring or clamp, which secures the latched-in spring. A plurality of catches may be provided, for example, on the side part 24 (and also on the side part 25), which, when the side part 24 is fastened on the framework 1, snap or latch into corresponding countersprings on the vertical members 11 and 12.

The top frame 17, the side parts 24 and 25 and the base unit 15 are designed such that, when the housing is in the assembled state, the surfaces of these components which can be seen from the outside are in alignment with one another.

Examples of plastics which may be used for the plastic parts in use, for example top frame, side-part arrangements, framework, etc., are polyamides, polyacetal resins, polycarbonates, polyphenylene ether, polyolefins, styrene/butadiene copolymers, etc.

Figure 11:
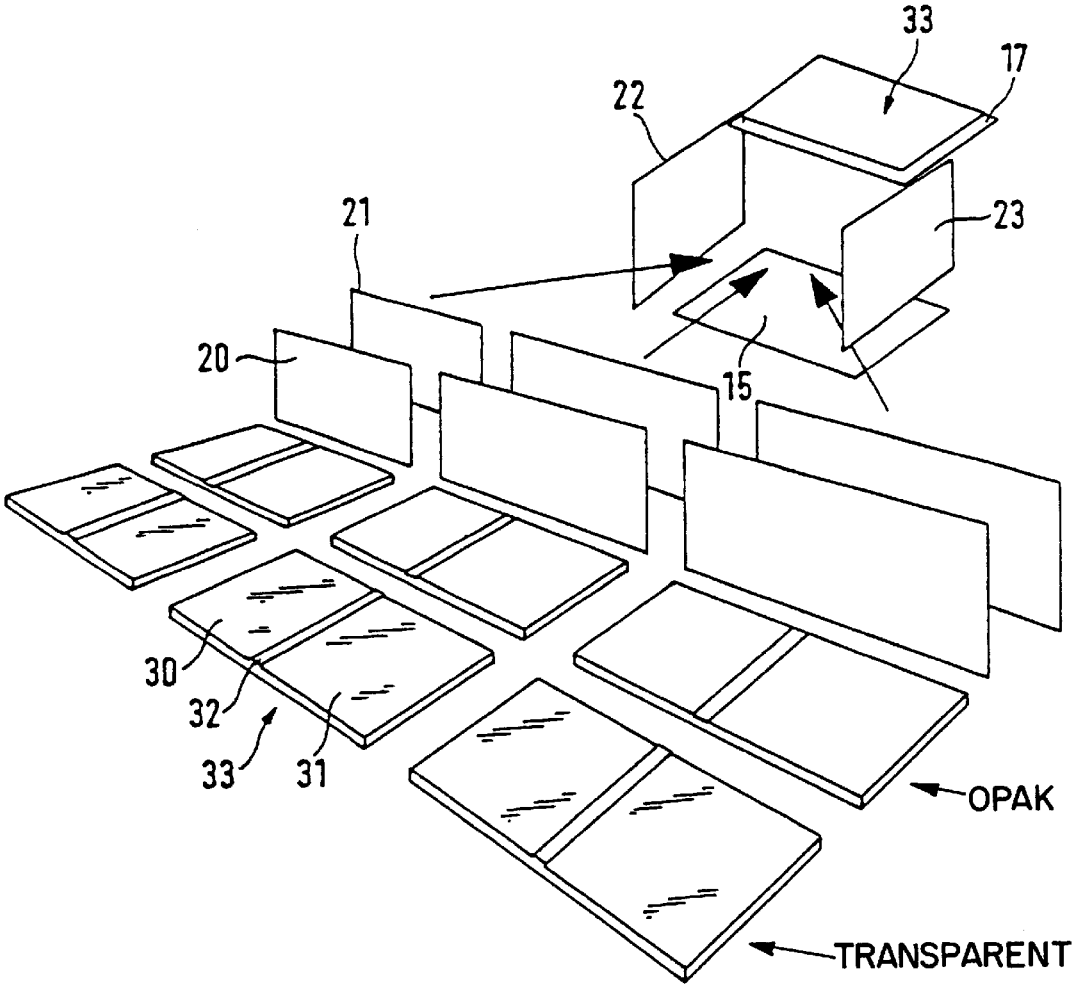
FIG. 11 shows a schematic illustration of those modular components together which belong to the first embodiment of the present invention, in accordance with FIGS. 1 to 3.

FIG. 11 shows schematically how housings, of the present invention, according to the embodiment of FIGS. 1 to 3 can be constructed with different volumes (e.g. three different volumes in FIG. 11) using standardized and modular components. The basis for the modular construction is that the side parts 24 and 25, and also the side parts 22 and 23, are at least of the same shape and dimensions for all the volumes of the housing type. Top frame 17, base unit 15, front-wall panel 20, rear-wall panel 21 and the cover arrangement 33 with the covers 30 and 31 are adapted to the different volumes of the housing in terms of their length dimensions. To give an example of an inventive modular housing system with four different volumes, the dimensions of the outline of the side parts 24 and 25, which are fixed for all volumes, are approximately 810 mm×650 mm (without the height of the rollers 16). The length dimensions of the top frame 17, base unit 15 (base panel), front-wall panel 20, rear-wall panel 21 and cover arrangement 33 are approximately 530 mm to 680 mm for a first volume, approximately 900 mm to 1050 mm for a second volume, approximately 1100 mm to 1250 mm for a third volume and approximately 1350 mm to 1500 mm for a fourth volume. In this respect, you are referred to the self-explanatory table of dimensions of FIG. 3.

FIGS. 5 and 6 show a framework 1.1 according to a second embodiment of the invention, in the case of which parts which are the same as, or similar to, those in the abovementioned, first embodiment are made of the same materials. The framework 1.1 shown comprises, in the same way as the framework 1 of the first embodiment, four vertical members 11.1, 12.1, 13.1 and 14.1 which are arranged on the side edges of an imaginary cuboid, are provided perpendicularly with respect to a base unit 15.11 of the framework 1.1 and are fastened on the base unit 15.11, e.g. by screwed connection. The base unit 15.11 is constructed in the same way as the framework 1 of the first embodiment. The rear vertical members 12.1 and 14.1 are of the same length, but are longer than the front vertical members 11.1 and 13.1, which are of the same length as each other.

Fastened on the underside of the base unit 15.11 of the framework 1.1 are four rollers 16.1, as in the first embodiment of the present invention.

Opposite the base unit 15.11, the vertical members 11.1, 12.1, 13.1 and 14.1 are fastened at the ends on a top frame 17.1 which runs all the way round but, unlike the first embodiment of the present invention, runs with the framework 1.1 at this point, as can be seen clearly from FIG. 6, in a plane which is oblique or inclined with respect to the plane of the base unit 15.11, and in this respect the top frame 17.1 is designed differently from the top frame 17 of the framework 1. Inside, the top frame 17.1 is provided, once again, with two guides 17.4 one above the other, which may be designed, for example, as sunken grooves into which it is possible to insert corresponding covers 30.1 and 31.1, which may be curved (see FIGS. 8 and 12), of a cover arrangement 33.1.

Figure 8:
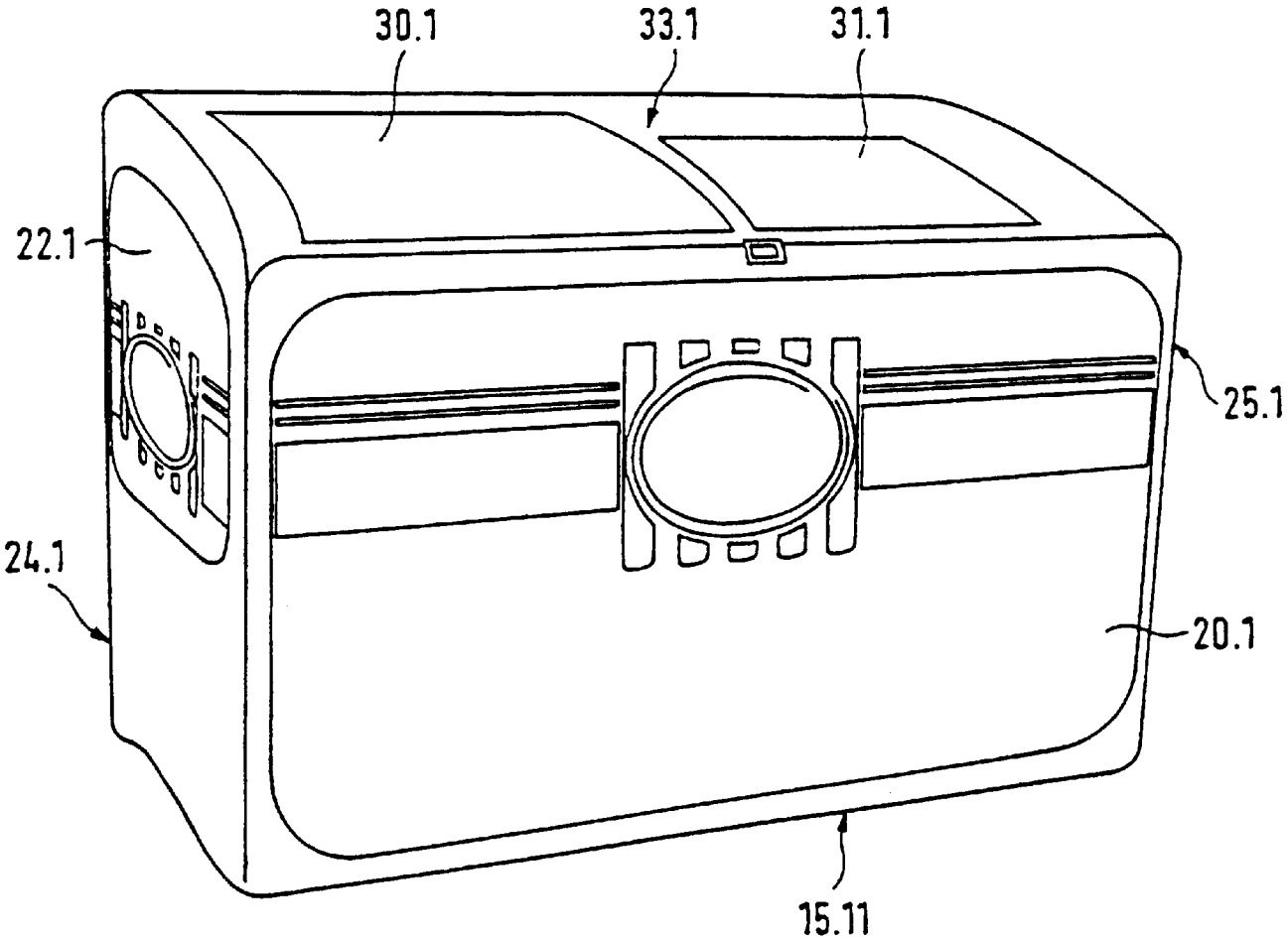
FIG. 8 shows a ready-assembled housing of the present invention with the framework of FIGS. 5 and 6.

As FIG. 8 shows, the housing of the second embodiment, similarly to the housing of the first embodiment, comprises a metallic, large-surface-area front-wall panel 20.1 which is arranged on the front side of the housing and, in turn, may be fastened, for example screwed, for example on retaining means provided for this purpose (not shown) on the vertical members 11.1 and 13.1 and/or on the top frame 17.1 and the base unit 15.11, it being possible for the front-wall panel 20.1 to be fastened, preferably in the region of its corners, on the retaining means or fastening surfaces arranged correspondingly on the framework 1.1. Opposite the front-wall panel 20.1, there is arranged on the rear side of the housing, that is to say in the region between the vertical members 12.1 and 14.1, a metallic rear-wall panel 21.1, which nevertheless, in the case of the second embodiment, is of a greater vertical dimension than the front-wall panel 20.1.

Arranged laterally on the housing, that is to say between the vertical members 11.1 and 12.1 and also between the vertical members 13.1 and 14.1, is, once again, in each case one metallic side panel (not shown). The side panels 22.1 and 23.1 are of identical dimensions, but are only located in the region of the top section on the sides of the housing. They may be of sheet steel and are fastened, e.g. by screwed connection or in the same way as in the first embodiment, on correspondingly designed retaining means or fastening surfaces provided on the vertical members 11.1, 12.1 and 13.1, 14.1 and/or on the top frame 17.1.

Also arranged laterally on the housing are side parts 24.1 and 25.1 which are identical in terms of outline and are each essentially in one piece. The side parts 24.1 and 25.1 are adapted, in terms of outline, to the top frame 17.1, which slopes down obliquely from the rear side to the front side, and they thus have an essentially oblique-angled top edge. The side parts 24.1 and 25.1 may be fitted on the framework 1.1 as in the case of the first embodiment.

Figure 12:
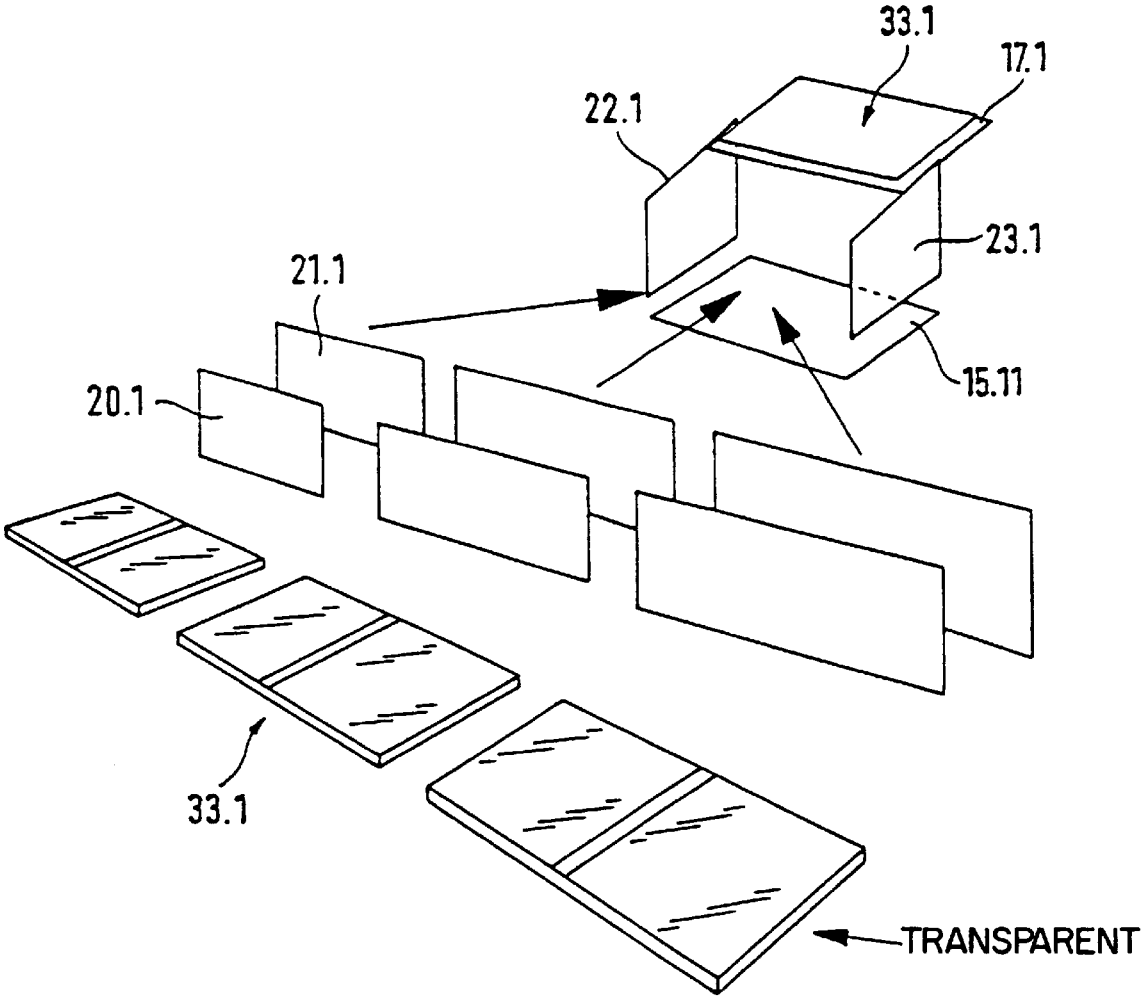
FIG. 12 shows a schematic illustration of those modular components together which belong to the second embodiment of the present invention, in accordance with FIGS. 5 and 6.

FIG. 12 shows schematically how housings, of the present invention, for the housing type of the second embodiment, of FIGS. 5 to 8, can be constructed with different volumes (e.g. three different volumes in FIG. 12) using standardized and modular components. The basis for the modular construction is that the side parts 24.1 and 25.1 are at least of identical outline for all the volumes. Top frame 17.1, base unit 15.11, front-wall panel 20.1, rear-wall panel 21.1 and the cover arrangement 33.1 are adapted to the different volumes of the housings in terms of their length dimensions. For an example of an inventive modular housing system according to the second embodiment with four different volumes, you are referred to the self-explanatory table of dimensions of FIG. 7.

Figure 9:
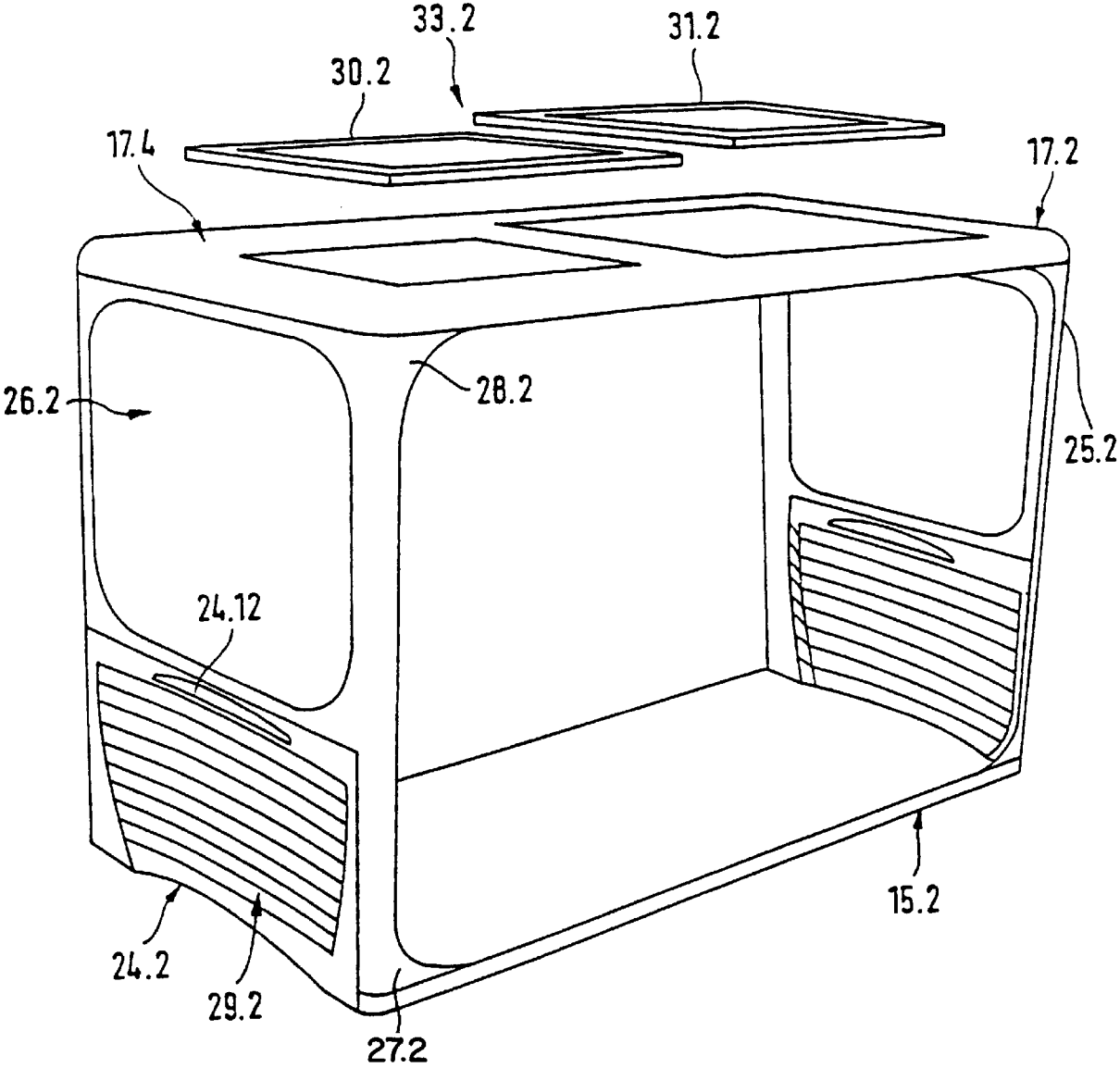
FIG. 9 shows a perspective view of the third embodiment of the present invention (without side panels or front-wall panel)

FIG. 9 shows a third embodiment of the inventive housing for a freezer cabinet, said housing having a base unit 15.2 which comprises a continuous, single-piece and essentially rectangular base panel. Fastened on the underside of the base panel of the base unit 15.2 are four rollers (not shown). Provided opposite the base unit 15.2 is a top frame 17.2 which has essentially a rectangular outer boundary and likewise a rectangular inner boundary. The top frame 17.2 is designed from plastic as a single-piece frame. The rectangular top frame 17.2 is rounded in the corner regions. The longitudinal and transverse edges of the top frame 17.2 which are oriented upwards away from the housing are also rounded. As in the case of the first embodiment of the invention, the display of a digital thermometer 18 is integrated in the top frame 17.2. Inside, the top frame 17.2 is provided with two guides 17.4 one above the other, which, as in the case of the first embodiment, serve for guiding covers 30.2 and 31.2 inserted therein.

In addition, arranged laterally on the housing of the third embodiment, located opposite one another between the top frame 17.2 and the base unit 15.2, are side parts 24.2 and 25.2 which are at least of the same shape and dimensions, or are identical, and are each essentially in one piece. Each of these side parts 24.2 and 25.2 is of essentially rectangular outline. In the top region, the side part 24.2 has an opening 26.2, through which a side panel (not shown in FIG. 9) is visible. However, in particular in the corner region, the outline of the opening 26.2 is smaller than the outline of the side panel. The side part 24.2 (and also the side part 25.2) extends from the side region of the housing around the vertical edges, by way of corner pieces 27.2, 28.2, to the front side of the housing, and thus also covers, in particular, the adjoining cover regions of a front-wall panel (not shown), which is constructed as in the first embodiment of the invention. Towards the base unit 15.2, the side part 24.2 (and also the side part 25.2) have a plurality of mutually parallel ventilation slits 29.2. The ventilation slits 29.2 may also be formed in a cover which can be inserted into the side part 24.2 or may be articulated thereon, for example with swing action. A handle 24.12 is formed in each case on the side parts 24.2 and 25.2.

The side parts 24.2 and 25.2 are fastened on the top frame 17.2 and the base unit 15.2 by fastening means (not shown), e.g. by means of a corresponding screwed connection. In the third embodiment, the side parts 24.2 and 25.2 combine the supporting and carrying functions of the vertical members 11, 12, 13 and 14 and the function of the side parts 24 and 25 of the first embodiment of the present invention and, accordingly, are of stable design. The top frame 17.2, the side parts 24.2 and 25.2 and the base unit 15.2 are designed such that, when the housing is in the assembled state, the surfaces of these components which can be seen from the outside are in alignment with one another. The front-wall panel and also the rear-wall panel may be fastened, for example screwed, for example on retaining means designed for this purpose (not shown) or fastening surfaces on the side parts 24.2 and 25.2 and/or on the top frame 17.2 and the base unit 15.2, the front-wall panel being fastened, preferably in the region of the cornerpieces 27.2 and 28.2 of the side parts 24.2 and 25.2, on these cornerpieces.

In the ready-assembled state, the housing of the third embodiment looks the same as the housing in FIG. 4.

What has been said above in relation to FIG. 11 and the table of dimensions of FIG. 3 in conjunction with the first embodiment can also be applied to the modularity and the dimensions of the housings of the third embodiment of the invention.

What is claimed is:

1. A housing for a freezer cabinet for storing frozen foodstuffs, the housing comprising:

a base unit of rectangular outline, a top frame made of plastic which is also rectangular, said top frame being located opposite the base unit, enclosing an access opening and bearing a movable cover arrangement which closes or releases the access opening of said top frame, two mutually opposite side-part members provided laterally on the housing, of essentially the same outline, said member extending from the base unit to the top frame of the housing, each of said members having an opening therein, side panels of metal, each of said side panels being arranged on a side of the housing, the surfaces of said side panels being visible through the openings in the side-part members, a rear-wall panel positioned on a rear side of the housing, said rear-wall panel being made of metal and extending between the side-part members from the top frame to the base unit, and a front-wall panel positioned on a front side of the housing, said front-wall panel being made of metal, being located opposite the rear-wall panel and extending between the side-part members from the top frame to the base unit, said side-part members, base unit, top frame with cover arrangement, the front-wall panel and the rear-wall panel defining a housing volume.

2. A housing according to claim 1 wherein the side-part members extend as at least one section into the region of the front side of the housing.

3. A housing according to claim 2 wherein the side-part members extend through corner pieces as sections, to the front side of the housing in the region of the corners of the front-wall panel.

4. A housing according to claim 1 wherein the housing has a framework on which the side-part members, the front-wall panel, the rear-wall panel and the side panels are fastened.

5. A housing according to claim 4 wherein the framework comprises four vertical members which extend between the base unit and the top frame perpendicularly with respect to a plane of the base unit.

6. A housing according to claim 5 wherein the vertical members are of the same length.

7. A housing according to claim 6 wherein the vertical members on the rear side of the housing are longer than the vertical members on the front side of the housing.

8. A housing according to claim 7 wherein the framework is made of plastic.

9. A housing according to claim 8 wherein rollers are fastened on the underside of the base unit.

10. A housing according to claim 9 wherein each of the side-part members comprises a single-piece side part.

11. A housing according to claim 10 wherein the side-part members have ventilation slits.

12. A housing according to claim 11 wherein each of the side-part members includes a handle.

13. A housing according to claim 12 wherein at least one of the front-wall panel and the side panels are retained or fastened on the side-part members.

14. A modular housing system defining housings of different volumes, each housing being provided for a freezer cabinet for storing frozen foodstuffs, and comprising a base unit of rectangular outline, a top frame made of plastic, which is also rectangular and is located opposite the base unit, said top frame enclosing an access opening and bearing a movable cover arrangement which closes or releases the access opening of said top frame, two mutually opposite side-part arrangements provided laterally on the housing and extending from the base unit to the top frame of the housing, side panels of metal, each of said side panels being arranged on a side of the housing, the surfaces of said side panels being visible through openings in the side-part members, a rear-wall panel situated on a rear side of the housing, said rear-wall panel being made of metal and extending between the side part arrangements from the top frame to the base unit, and a front-wall panel situated on a front side of the housing made of metal, located opposite the rear-wall panel and extending between the side-part arrangements from the top frame to the base unit, the side-part arrangements, the base unit, the top frame with cover arrangement, the front-wall panel and the rear-wall panel defining a housing volume, the side-part arrangements being of the same shape and having the same dimensions for all the volumes of the housings.

15. A modular housing system according to claim 14 wherein, in accordance with different volumes, the front-wall panels are of different length dimensions.

16. A modular housing system according to claim 15 wherein, in accordance with the different volumes of the housings, the rear-wall panels are also of different length dimensions.

17. A modular housing system according to claim 14 wherein the front-wall panel and the rear-wall panel of a housing are of the same shape and the same dimensions.

18. A modular housing system according to claim 17 wherein the side-part arrangements and side panels are of the same shape and the same dimensions for all the housings at least of one housing type.

19. A modular housing system according to claim 18 wherein, in accordance with different volumes of the housings, the cover arrangements are of different length dimensions.

20. A modular housing system according to claim 19 wherein each cover arrangement has two panel-like, rectangular covers of the same size and said covers being either transparent or non-transparent.

* * * * *